US009200633B2

(12) United States Patent
Yamada et al.

(10) Patent No.: US 9,200,633 B2
(45) Date of Patent: Dec. 1, 2015

(54) SCROLL COMPRESSOR WITH OLDHAM RING HAVING SCROLL-SIDE KEYS AND BEARING-SIDE KEYS

(75) Inventors: Sadayuki Yamada, Shiga (JP); Manabu Sakai, Shiga (JP); Takeshi Imanishi, Shiga (JP); Atsushi Sakuda, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 177 days.

(21) Appl. No.: 13/579,767

(22) PCT Filed: Nov. 16, 2011

(86) PCT No.: PCT/JP2011/006378
§ 371 (c)(1),
(2), (4) Date: Aug. 17, 2012

(87) PCT Pub. No.: WO2012/101696
PCT Pub. Date: Aug. 2, 2012

(65) Prior Publication Data

US 2012/0308422 A1 Dec. 6, 2012

(30) Foreign Application Priority Data

Jan. 26, 2011 (JP) ..... 2011-013610
Apr. 20, 2011 (JP) ..... 2011-093755
Apr. 20, 2011 (JP) ..... 2011-093756

(51) Int. Cl.

| | |
|---|---|
| ***F01C 17/06*** | (2006.01) |
| ***F01C 1/02*** | (2006.01) |
| ***F04C 2/02*** | (2006.01) |
| ***F04C 18/02*** | (2006.01) |
| ***F01C 21/10*** | (2006.01) |

(52) U.S. Cl.
CPC ..... *F04C 18/0207* (2013.01); *F01C 17/066* (2013.01); *F01C 21/10* (2013.01); *F04C 18/0253* (2013.01)

(58) Field of Classification Search
CPC . F01C 17/066; F04C 18/0207; F04C 18/0253
USPC ..... 418/55.3, 55.1; 464/102, 104, 105
See application file for complete search history.

(56) References Cited

U.S. PATENT DOCUMENTS 4,121,438 A * 10/1978 McCullough ..... 464/102
5,330,334 A 7/1994 Bush et al.

(Continued)

FOREIGN PATENT DOCUMENTS

| | | |
|---|---|---|
| JP | 5-079301 | 3/1993 |
| JP | 6-088579 | 3/1994 |
| JP | 7-151072 | 6/1995 |

(Continued)

*Primary Examiner* — Mary A Davis
*Assistant Examiner* — Deming Wan
(74) *Attorney, Agent, or Firm* — Hamre, Schumann, Mueller & Larson, P.C.

(57) ABSTRACT

A scroll compressor is characterized in that by reducing an Oldham ring 57 and an orbiting scroll 12 in size, a compressing mechanism 4 is reduced in size, a pair of scroll-side keys 57*b* are disposed at locations deviated from each other from a diameter line of the ring portion 57*a* so that a distance between the pair of scroll-side keys 57*b* becomes not less than a width of the scroll-side keyway 12*d*, and a pair of main bearing-side keys 57*c* are disposed at locations deviated from each other from the diameter line of the ring portion 57*a* so that a distance between the pair of main bearing-side keys 57*c* becomes not less than a width of the main bearing-side keyways 51*a*.

7 Claims, 11 Drawing Sheets

(56) References Cited

U.S. PATENT DOCUMENTS

| | | | | |
|---|---|---|---|---|
| 6,146,118 | A * | 11/2000 | Haller et al. | 418/55.3 |
| 6,752,606 | B2 * | 6/2004 | Koo | 418/55.3 |

FOREIGN PATENT DOCUMENTS

| | | |
|---|---|---|
| JP | 7-174081 | 7/1995 |
| JP | 2000-213474 | 8/2000 |

* cited by examiner

SCROLL COMPRESSOR WITH OLDHAM RING HAVING SCROLL-SIDE KEYS AND BEARING-SIDE KEYS

TECHNICAL FIELD

The present invention relates to a scroll compressor using a rotation-preventing mechanism for orbiting a driven member such that the driven member does not rotate when a rotation force of a driving member is transmitted to the driven member.

BACKGROUND TECHNIQUE

Conventionally, an Oldham ring is widely used for a scroll compressor as one of rotation-preventing mechanisms for orbiting a driven member such that the driven member does not rotate when a rotation force of a driving member is transmitted to the driven member.

A conventional scroll compressor using the Oldham ring which is one of the rotation-preventing mechanisms will be described with reference to drawings (see patent document 1 for example). FIG. 10(*a*) is an exploded perspective view of a compressing mechanism of a conventional scroll compressor as viewed from a fixed scroll. FIG. 10(*b*) is an exploded perspective view of an orbiting scroll and an Oldham ring of the conventional scroll compressor as viewed from their back surfaces. FIG. 11 is a plan view of a bearing member and the Oldham ring of the scroll compressor shown in FIG. 10 as viewed from a back surface of the bearing member 106.

FIG. 11 shows, by dotted lines, an orbiting panel 108 of the orbiting scroll 109 and a keyway 115. An envelope circle in which an outer diameter of a seal member 121 disposed in the bearing member 106 is in contact with a back surface 117 of the orbiting panel 108 is shown by a phantom line.

In FIGS. 10(*a*) and 10(*b*), the compressing mechanism 101 includes a crankshaft 103, the bearing member 106, the orbiting scroll 109, the fixed scroll 111 and the Oldham ring 112.

The crankshaft 103 includes an eccentric shaft 102. The bearing member 106 includes a main bearing 105 which rotatably supports a main shaft 104 of the crankshaft 103. The orbiting scroll 109 includes a driving shaft 107 which is rotatably fitted into the eccentric shaft 102, the driving shaft 107 is provided on the orbiting panel 108, and an orbiting scroll blade 110 is provided on the orbiting panel 108 on a side opposite from the driving shaft 107. The fixed scroll 111 includes a fixed scroll blade (not shown) which meshes with the orbiting scroll blade 110 of the orbiting scroll 109 to form a plurality of compression spaces. An outer periphery 122 of the bearing member 106 and the fixed scroll 111 which is in contact with the outer periphery 122 are fixed to each other through a plurality of bolts.

A pair of scroll-side keys 113 are provided on one of surfaces of the Oldham ring 112, and a pair of bearing-side keys 114 are provided on the other surface of the Oldham ring 112.

A pair of scroll-side keyways 115 with which the scroll-side keys 113 slide are provided on the back surface 117 of the orbiting panel 108 of the orbiting scroll. 109 on its diameter line.

Bearing-side keyways 116 on which the bearing-side keys 114 slide are provided in a back surface 118 of the bearing member 106 on its diameter line.

A sliding direction of the scroll-side keys 113 the scroll-side keyways 115 and a sliding direction of the bearing-side keys 114 in the bearing-side keyways 116 intersect with each other at right angles.

A thrust support 119 which supports the orbiting panel 108 in a thrust direction is provided on the back surface 118 of the bearing member 106. An annular groove 120 is provided in the thrust support 119. The seal member 121 is provided on the annular groove 120. Different pressures are applied to an inner side and an outer side of the seal member 121, and when the compressor is operated, the orbiting scroll 109 is biased toward the fixed scroll 111 under an optimal force.

Rotation of the crankshaft 103 is transmitted to the driving shaft 107 of the orbiting scroll 109. The orbiting scroll 109 is moved in a first direction which is restricted by the scroll-side keys 113 and the scroll-side keyways 115, and in a second direction which is restricted by the bearing-side keys 114 and the bearing-side keyways 116, and rotation of the orbiting scroll 109 is inhibited. Since the first direction and the second direction intersect with each other at right angles, movement in the first direction and movement in the second direction are combined with each other, and the orbiting scroll 109 orbits with an orbiting radius e. As the orbiting scroll 109 orbits, the seal member 121 moves with the orbiting radius a with its surface which is in contact with the orbiting panel 108. A diameter of an envelope circle of the seal member 121 at its contact surface is a value of an outer diameter of the seal member 121 to which twice of the orbiting radius e is added.

According to the above-described configuration, if a rotation force from a motor (not shown) is transmitted from the crankshaft 103 to the orbiting scroll 109, the plurality of compression spaces formed between the orbiting scroll 109 and the fixed scroll 111 move from an outer peripheral side toward an inner peripheral side and with this movement, fluid is compressed. Therefore, fluid sucked from a suction port 123 of the compressing mechanism 101 is compressed and discharged from a discharge port 124.

PRIOR ART DOCUMENT

Patent Document

[Patent Document 1] Japanese Patent Application Laid-open No. 2000-213474

SUMMARY OF THE INVENTION

Problem to be Solved by the Invention

According to the conventional configuration, however, since the pair of scroll-side keys 113 and the pair of bearing-side keys 114 of the Oldham ring 112 are disposed on a short axis and a long axis of the ring portion such that the keys 113 and the keys 114 intersect with each other at right angles, there are problems that there is a limit to reduce a diameter of the ring portion and the ring portion and an inner diameter of the bearing member 106 interfere with each other. Further, since the scroll-side keys 113 and the bearing-side keys 114 project from an outer diameter of the ring portion, there is a problem that it is necessary to provide a release portion 125 for avoiding the interference with the inner diameter of the bearing member 106.

The present invention has been accomplished to solve the conventional problems, and it is an object of the invention to provide a scroll compressor in which the compressing mechanism is reduced in size by reducing the Oldham ring and the orbiting scroll in size.

Means for Solving the Problems

A first aspect of the present invention provides a scroll compressor comprising a compressing mechanism, in which the compressing mechanism comprises a crankshaft including an eccentric shaft, a main bearing member which rotatably supports the crankshaft, an orbiting scroll which is rotatably fitted to the eccentric shaft, a fixed scroll which meshes with the orbiting scroll to form a compression space, and an Oldham ring which prevents the orbiting scroll from rotating, the Oldham ring comprises a ring-shaped ring portion, a pair of scroll-side keys provided on one of surfaces of the ring portion, and a pair of main bearing-side keys provided on the other surface of the ring portion, the orbiting scroll is provided with scroll-side keyways with which the scroll-side keys slide, the main bearing member is provided with main bearing-side keyways with which the main bearing-side keys slide, a sliding direction of the scroll-side keys in the scroll-side keyways and a sliding direction of the main bearing-side keys in the main bearing-side keyways intersect with each other at right angles, wherein the pair of scroll-side keys are disposed at locations deviated from each other from a diameter line of the ring portion so that a distance between the pair of scroll-side keys becomes equal to or greater than a width of the scroll-side keyway, and the pair of main bearing-side keys are disposed at locations deviated from each other from the diameter line of the ring portion so that a distance between the pair of main bearing-side keys becomes equal to or greater than a width of the main bearing-side keyway.

According to a second aspect, in the scroll compressor of the first aspect, the scroll-side key and the main bearing-side key do not project from an outer diameter of the ring portion, and do not project from an inner diameter of the ring portion.

According to a third aspect, in the scroll compressor of the first or second aspect, sliding surfaces which are side surfaces of the pair of scroll-side keys and which slide with the scroll-side keyways, and sliding surfaces which are side surfaces of the pair of the main bearing-side keys and which slide with the main bearing-side keyways include load-side sliding surfaces which receive loads depending upon a rotation direction of the crankshaft, and non-load-side sliding surfaces which do not receive loads depending upon the rotation direction of the crankshaft, and an area of the non-load-side sliding surface is smaller than an area of the load-side sliding surface.

According to a fourth aspect, in the scroll compressor of the third aspect, the area of the non-load-side sliding surface is not less than half of the area of the load-side sliding surface.

According to a fifth aspect, in the scroll compressor of the first or second aspect, sliding surfaces which are side surfaces of the pair of scroll-side keys and which slide with the scroll-side keyways include load-side sliding surfaces which receives loads depending upon a rotation direction of the crankshaft and non-load-side sliding surfaces which do not receive loads depending upon the rotation direction of the crankshaft, and the non-load-side sliding surface projects outward from the scroll-side keyway, and the load-side sliding surface does not project outward from the scroll-side keyway.

According to a sixth aspect, in the scroll compressor of the fifth aspect, a projecting area of the non-load-side sliding surface projecting outward from the scroll-side keyway is not more than half of an entire area of the load-side sliding surface.

According to a seventh aspect, in the scroll compressor of the first aspect, the pair of scroll-side keys and the pair of main bearing-side keys are formed by individual molding, and they are assembled and fixed to the ring portion.

According to an eighth aspect, in the scroll compressor of the first aspect, side surfaces of the pair of scroll-side keys and/or side surfaces of the pair of main bearing-side keys include sliding surfaces which slide with the scroll-side keyways and/or the main bearing-side keyways, and non-sliding surfaces which do not slide with the scroll-side keyways and/or the main bearing-side keyways, and the sliding surfaces and the non-sliding surfaces have the same shapes.

According to a ninth aspect, in the scroll compressor of the eighth aspect, a line segment which connects centers of the pair of scroll-side keys with each other and a line segment which connects centers of the pair of main bearing-side keys intersect with each other at right angles at a center of the ring portion.

Effect of the Invention

According to the scroll compressor of the invention, since the outer diameter of the Oldham ring and the outer diameter of the orbiting scroll can be reduced, the compressing mechanism can be reduced in size, and it is possible to design the compressing mechanism having an increased orbiting radius.

EXPLANATION OF SYMBOLS

Figure 1:
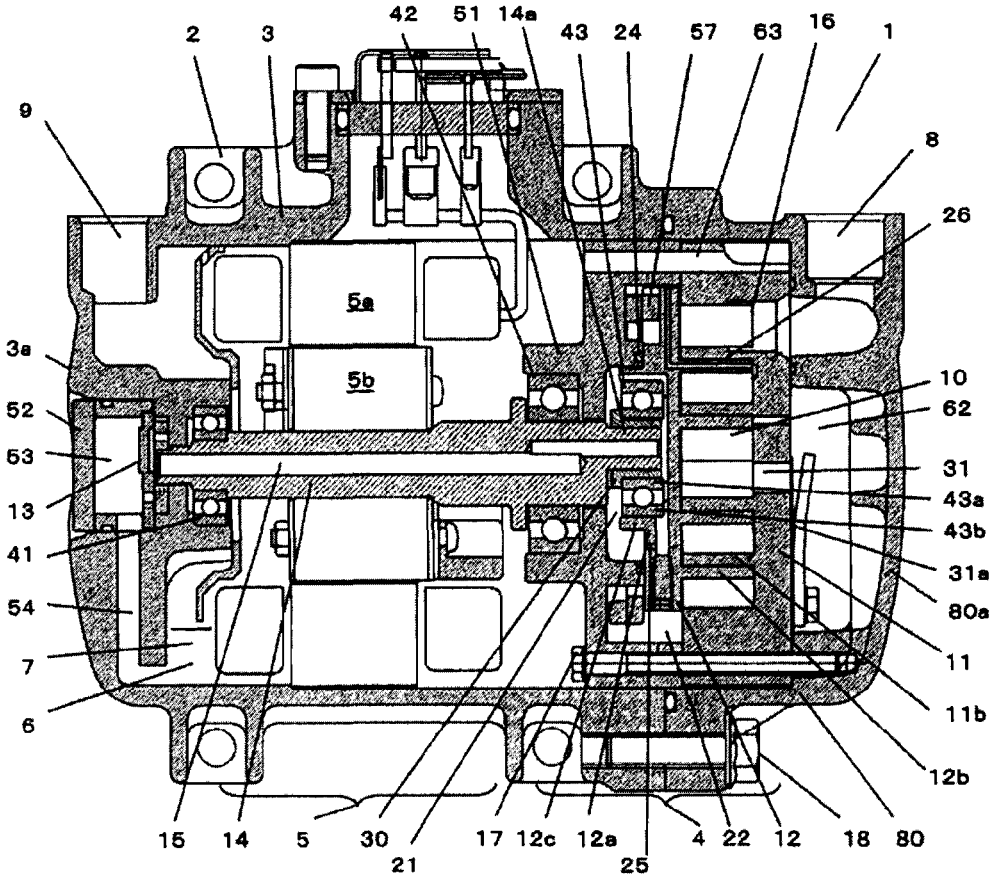
FIG. 1 is a sectional view of a scroll compressor according to a first embodiment of the present invention.

4 compressing mechanism
5 motor

7 lubricant oil
11 fixed scroll
12 orbiting scroll
12*a* panel
12*c* cylindrical portion
12*d* scroll-side keyway
14 crankshaft
14*a* eccentric shaft
51 main bearing member
51*a* main bearing-side keyway
57 Oldham ring
57*a* ring portion
57*b* scroll-side key
57*c* main bearing-side key
57*bxw*, 57*cxw* load-side sliding surface
57*bxu*, 57*cxu* non-load-side sliding surface

MODE FOR CARRYING OUT THE INVENTION

According to the first aspect, the pair of scroll-side keys are disposed at locations deviated from each other from a diameter line of the ring portion so that a distance between the pair of scroll-side keys becomes equal to or greater than a width of the scroll-side keyway, and the pair of main bearing-side keys are disposed at locations deviated from each other from the diameter line of the ring portion so that a distance between the pair of main bearing-side keys becomes equal to or greater than a width of the main bearing-side keyway. According to this, an outer diameter of the ring portion can be made small and hence, the compressing mechanism can be made compact, and it is possible to design the compressing mechanism such that an orbiting radius is further increased in size.

According to the second aspect, in the first aspect, the scroll-side key and the main bearing-side key do not project from an outer diameter of the ring portion, and do not project from an inner diameter of the ring portion. Therefore, it is unnecessary to provide a release portion in the vicinity of the keyway of the main bearing member for avoiding interference with respect to the key provided in the ring portion. A shape in the vicinity of the key of a mold which manufactures a raw material of the Oldham ring is simplified and thus, a life span of the mold is increased, and a lathe can be used for machining inner and outer peripheral surfaces of the ring portion. Therefore, productivity is enhanced, strengths of root portions of the keys are enhanced and reliability is enhanced.

According to the third aspect, in the first or second aspect, sliding surfaces which are side surfaces of the pair of scroll-side keys and which slide with the scroll-side keyways, and sliding surfaces which are side surfaces of the pair of the main bearing-side keys and which slide with the main bearing-side keyways include load-side sliding surfaces which receive loads depending upon a rotation direction of the crankshaft, and non-load-side sliding surfaces which do not receive loads depending upon the rotation direction of the crankshaft, and an area of the non-load-side sliding surface is smaller than an area of the load-side sliding surface. Therefore, since the width of the ring portion of the Oldham ring can be made small and the outer diameter of the Oldham ring can be made small, it is possible to reduce the compressing mechanism in size, and it is possible to design the compressing mechanism such that the orbiting radius is further increased in size.

According to the fourth aspect, in the third aspect, the area of the non-load-side sliding surface is not less than half of the area of the load-side sliding surface. Therefore, even in an unstable operation state immediately after start of operation, or in a transitory state or when the compressor is at rest, the compressor can be operated stably and the reliability is enhanced.

According to the fifth aspect, in the first or second aspect, sliding surfaces which are side surfaces of the pair of scroll-side keys and which slide with the scroll-side keyways include load-side sliding surfaces which receives loads depending upon a rotation direction of the crankshaft and non-load-side sliding surfaces which do not receive loads depending upon the rotation direction of the crankshaft, and the non-load-side sliding surface projects outward from the scroll-side keyway, and the load-side sliding surface does not project outward from the scroll-side keyway. Therefore, the outer diameter of the Oldham ring can be made small, and since the non-load-side sliding surfaces of the pair of keys on the one surface side project toward the outer diameter of the orbiting scroll, the outer diameter of the orbiting scroll can be correspondingly reduced in size by the projecting amount. Hence, the compressing mechanism can be made compact, and it is possible to design the compressing mechanism such that the orbiting radius is increased in size.

According to the sixth aspect, in the fifth aspect, a projecting area of the non-load-side sliding surface projecting outward from the scroll-side keyway is rot more than half of an entire area of the load-side sliding surface. Since the areas of the non-load-side sliding surfaces are not less than halves of the areas of the load-side sliding surfaces, even in an unstable operation state immediately after start of operation, or in a transitory state or when the compressor is at rest, the compressor can be operated stably and the reliability is enhanced.

According to the seventh aspect, in the first aspect, the pair of scroll-side keys and the pair of main bearing-side keys are formed by individual molding, and they are assembled and fixed to the ring portion. If light and inexpensive material is employed for the ring portion, it is possible to reduce the scroll compressor in weight and cost, and if material having excellent sliding performance is employed, the reliability is enhanced.

According to the eighth aspect, in the first aspect, side surfaces of the pair of scroll-side keys and/or side surfaces of the pair of main bearing-side keys include sliding surfaces which slide with the scroll-side keyways and/or the main bearing-side keyways, and non-sliding surfaces which do not slide with the scroll-side keyways and/or the main bearing-side keyways, and the sliding surfaces and the non-sliding surfaces have the same shapes. Therefore, it becomes easy to machine the surface on the side of the key, the productivity is enhanced, and since there is no directional property of the side surface of the key, errors when assembling with the ring portion are eliminated and the productivity is enhanced.

According to the ninth aspect, in the eighth aspect, a line segment which connects centers of the pair of scroll-side keys with each other and a line segment which connects centers of the pair of main bearing-side keys intersect with each other at right angles at a center of the ring portion. Since front and back of the rotation-preventing mechanism are the same, assembling error are eliminated and the productivity is enhanced.

Embodiments of the present invention will be described with reference to the drawings below. The invention is not limited to the embodiments.

FIRST EMBODIMENT

Figure 2:
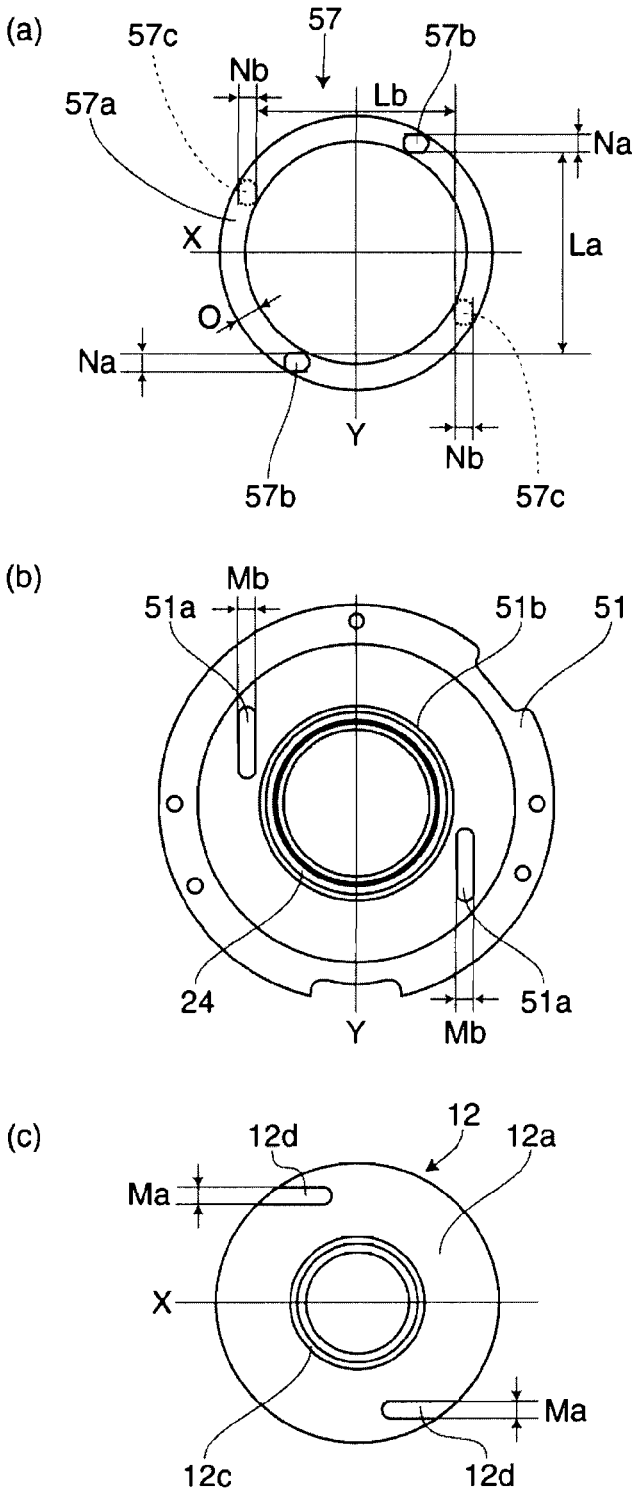
FIG. 2(*a*) is a plan view of an Oldham ring of the scroll compressor of the first embodiment as viewed from a fixed scroll, FIG. 2(*b*) is a plan view of a main bearing member of the scroll compressor of the first embodiment as viewed from the fixed scroll, and FIG. 2(*c*) is a plan view of an orbiting scroll of the scroll compressor of the first embodiment as viewed from a back surface of a panel.

FIG. 1 is a sectional view of a scroll compressor according to a first embodiment of the present invention. FIG. 2(*a*) is a plan view of an Oldham ring of the scroll compressor of the first embodiment as viewed from a fixed scroll. FIG. 2(*b*) is a plan view of a main bearing member of the scroll compressor of the first embodiment as viewed from the fixed scroll. FIG. 2(*c*) is a plan view of an orbiting scroll of the scroll compressor of the first embodiment as viewed from a back surface of a panel.

Figure 3:
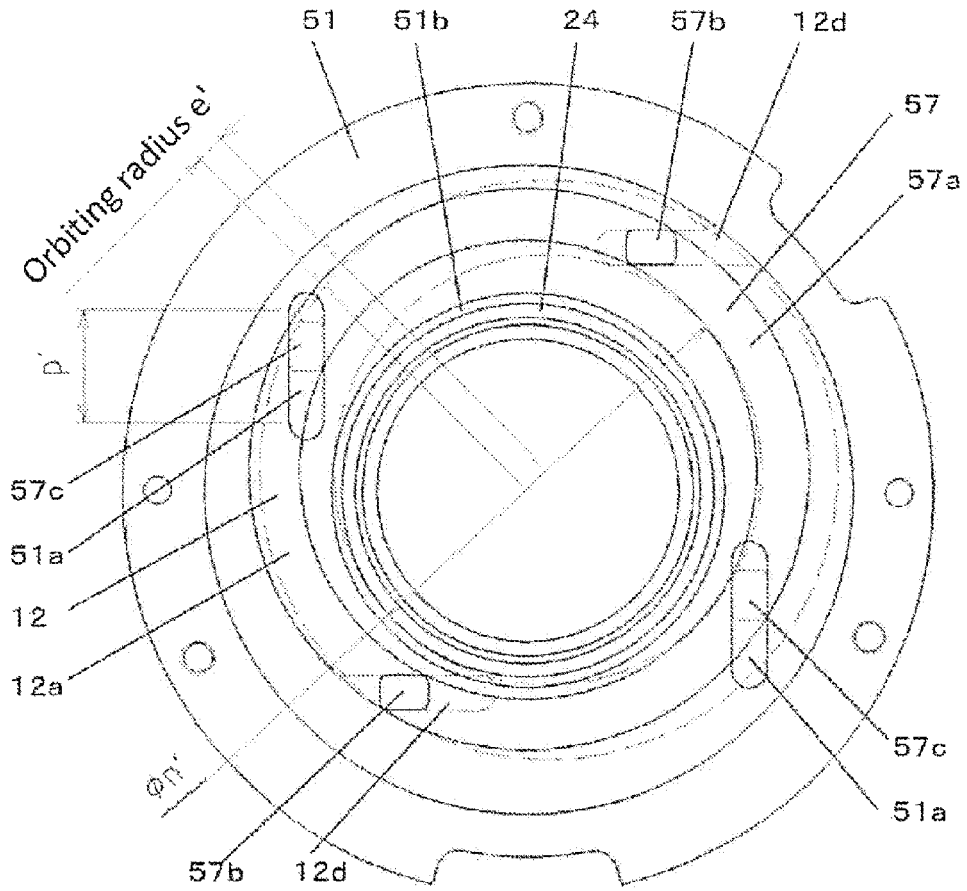
FIG. 3 is a plan view of a combination of the Oldham ring and the main bearing member of the first embodiment as viewed from the fixed scroll.

FIG. 3 is a plan view of a combination of the Oldham ring and the main bearing member of the first embodiment as viewed from the fixed scroll, and a panel of the orbiting scroll and keyways are shown by dotted lines. An envelope circle in which a seal member disposed on a main bearing member is in contact with the back surface of the panel is shown by a phantom line.

FIG. 1 shows a horizontal scroll compressor 1 which is horizontally installed by means of mounting legs 2 provided around a barrel of the scroll compressor 1.

The scroll compressor 1 includes a body casing 3. A compressing mechanism 4 and a motor 5 which drives the compressing mechanism 4 are incorporated in the body casing 3. The scroll compressor 1 also includes a liquid reservoir 6 in which liquid for lubricating various sliding portions including the compressing mechanism 4 is stored. The motor 5 is driven by a motor driving circuit (not shown). Fluid handled here is a refrigerant, and liquid such as lubricant oil 7 is employed as liquid for lubricating the various sliding portions and for sealing sliding portions of the compressing mechanism 4. It is preferable that the lubricant oil 7 has compatibility with the refrigerant, however, the present invention is not limited to this. Basically, the invention is not limited to the embodiment only if the scroll compressor 1 includes the body casing 3 in which the compressing mechanism 4 which sucks, compresses and discharges the refrigerant, the motor 5 which drives the compressing mechanism 4, and the liquid reservoir 6 in which liquid for lubricating the sliding portions including the compressing mechanism 4 are incorporated, and the motor 5 is driven by the motor driving circuit.

The compressing mechanism 4 includes a crankshaft 14, a main bearing member 51, an orbiting scroll 12, a fixed scroll 11 and an Oldham ring 57. The crankshaft 14 includes an eccentric shaft 14*a*. The main bearing member 51 rotatably supports the crankshaft 14. The orbiting scroll 12 is rotatably fitted over the eccentric shaft 14*a*. The fixed scroll 11 meshes with the orbiting scroll 12 to form a compression space 10. The Oldham ring 57 prevents the orbiting scroll 12 from rotating, and orbits the orbiting scroll 12.

The compressing mechanism 4 orbits the orbiting scroll 12 with respect to the fixed scroll 11, thereby moving the compression space 10, a volume thereof is varied, a refrigerant is sucked into the compression space 10, and after the refrigerant is compressed, it is discharged from the compression space 10.

The compression space 10 is formed by meshing a spiral lap 11*b* of the fixed scroll 11 and a spiral lap 12*b* of the orbiting scroll 12 with each other. The orbiting scroll 12 orbits by rotation of the crankshaft 14. The crankshaft 14 is rotated by the motor 5.

A refrigerant which returns from an external cycle is sucked tram a suction port 8 provided in a sub-casing 80, and is discharged into the external cycle from a discharge port 9 provided in the body casing 3.

The lubricant oil 7 stored in the liquid reservoir 6 is introduced into a crankshaft oil-supply passage 15 of the crankshaft 14 by driving a pump 13 using the crankshaft 14, or by utilizing a pressure difference in the body casing 3. The lubricant oil 7 which is introduced into the crankshaft oil-supply passage 15 is supplied to a high pressure region 21 formed on a back surface of a panel 12*a* of the orbiting scroll 12 by orbiting driving of the orbiting scroll 12.

A seal member 24 is disposed on the back surface of the panel. 12*a*. An inner side of the seal member 24 is a high pressure region 21, and an outer side of the seal member 24 is a back pressure chamber 22. That is, the high pressure region 21 and the back pressure chamber 22 are partitioned from each other by the seal member 24.

The orbiting scroll 12 is provided therein with a back pressure chamber oil-supply passage 25 which is connected to the back pressure chamber 22 from the high pressure region 21, and a compression chamber oil-supply passage 26 which is connected to the compression space 10 from the back pressure chamber 22.

One open end of the back pressure chamber oil-supply passage 25 reciprocates through the seal member 24, a portion of the lubricant oil 7 supplied to the high pressure region 21 lubricates an eccentric rolling bearing 43 and then is supplied to the back pressure chamber 22. By supplying the portion of the lubricant oil 7 to the back pressure chamber 22, a back pressure is applied to the orbiting scroll 12. The lubricant oil 7 supplied to the back pressure chamber 22 by the compression chamber oil-supply passage 26 is supplied to the compression space 10, and the lubricant oil 7 seals and lubricates between the fixed scroll 11 and the orbiting scroll 12. Another portion of the lubricant oil 7 which is supplied to the high pressure region 21 lubricates a main rolling bearing 42 and then flows out toward the motor 5 and it is collected into the liquid reservoir 6.

The pump 13, an auxiliary rolling bearing 41, the motor 5, and a main bearing member 51 having a main rolling bearing 42 are disposed in the body casing 3 in this order from a side of an end wall 3*a*. The pump 13 is accommodated from an outer surface of the end wall 3*a* and then, the pump 13 is fitted to the end wall 3*a* by a lid 52. Therefore, the pump 13 is hold between the end wall 3*a* and the lid 52.

A pump chamber 53 is formed inside of the lid 52. The pump chamber 53 includes a pumping passage 54 which is in communication with the liquid reservoir 6. The auxiliary rolling bearing 41 is supported by the end wall 3*a*, and supports an end of the crankshaft 14 which is connected to the pump 13.

The motor 5 rotates the crankshaft 14 by a stator 5*a* and a rotor 5*b*. The stator 5*a* is fixed to an inner periphery of the body casing 3 by shrink fitting. The rotor 5*b* is fixed to an intermediate portion of the crankshaft 14.

The main bearing member 51 is fixed to an inner periphery of the sub-casing 80 through a bolt 17, and supports an end of the crankshaft 14 on the side of the compressing mechanism 4 through the main rolling bearing 42. The fixed scroll 11 is mounted on an outer peripheral surface of the main bearing member 51 through a bolt (not shown). The orbiting scroll 12 is sandwiched between the main bearing member 51 and the fixed scroll 11. The orbiting scroll 12 and the fixed scroll 11 are opposed to each other. The Oldham ring 57 is provided between the main bearing member 51 and the orbiting scroll 12. The Oldham ring 57 prevents the orbiting scroll 12 from rotating, and makes the orbiting scroll 12 orbit.

The eccentric shaft 14*a* is integrally formed on an end of the crankshaft 14. A bushing 30 is fitted over and supported by the eccentric shaft 14*a*. The orbiting scroll 12 is supported by the bushing 30 through the eccentric rolling bearing 43 such that the orbiting scroll 12 can orbit. A cylindrical portion 12*c* projects from the back surface of the panel 12*a* of the orbiting scroll 12, and the eccentric rolling bearing 43 is accommodated in the cylindrical portion 12*c*. An inner race 43*a* of the eccentric rolling bearing 43 is fitted over the bushing 30, and an outer race 43*b* of the eccentric rolling bearing 43 is loosely fitted into the cylindrical portion 12*c* with a slight gap therebetween.

A portion of the compressing mechanism 4 that is exposed from the sub-casing 80 is covered with the body casing 3. An opening of the sub-casing 80 and an opening of the body casing 3 are butted against each other and they are fixed to each other through a bolt 18. An end wall 80*a* is formed on a side opposite from the end wall 3*a*.

The compressing mechanism 4 is located between the suction port 8 of the sub-casing 80 and the discharge port 9 of the body casing 3. The discharge port 9 is provided between the motor 5 and the end wall 3*a*. The compressing mechanism 4 includes a suction port 16 and a discharge port 31. The suction port 16 is in communication with the suction port 8 of the sub-casing 80. The discharge port 31 is provided with a reed valve 31*a*. A discharge chamber 62 is provided between the discharge port 31 and the end wall 80*a*. If the reed valve 31*a* opens, the discharge port 31 and the discharge chamber 62 are brought into communication with each other. The discharge chamber 62 is in communication with a space around the motor 5 through a communication passage 63. The discharge port 9 is in communication with the space around the motor 5. The communication passage 63 is formed between the fixed scroll 11 and the body casing 3, and between the main bearing member 51 and the body casing 3.

By the above-described configuration, the scroll compressor 1 moves as follows.

The motor 5 is driven by the motor driving circuit to rotate the crankshaft 14. The crankshaft 14 makes the compressing mechanism 4 orbit, and drives the pump 13. The pump 13 supplies lubricant oil 7 in the liquid reservoir 6 to the compressing mechanism 4. The lubricant oil 7 lubricates the compressing mechanism 4, and seals the compressing mechanism 4.

A refrigerant which returns from the refrigeration cycle is sucked into the compression space 10 from the suction port 8 of the sub-casing 80 and from the suction port 16 provided in the fixed scroll 11, the refrigerant is compressed and then is discharged from the discharge port 31 into the discharge chamber 62. A refrigerant which is discharged into the discharge chamber 62 enters the space around the motor 5 through the communication passage 63, cools the motor 5 and is discharged from the discharge port 9. While the refrigerant discharged into the discharge chamber 62 is discharged from the discharge port 9, lubricant oil 7 is separated from the refrigerant by the action of collision and squeezing. The auxiliary rolling bearing 41 is lubricated by the lubricant oil 7 which is mixed in the refrigerant.

As shown in FIG. 2(*a*), the Oldham ring 57 includes a ring portion 57*a* which is formed into an O-ring shape having a constant width, a pair of scroll-side keys 57*b* provided on one of surfaces of the ring portion 57*a*, and a pair of main bearing-side keys 57*c* provided on the other surface of the ring portion 57*a*.

As shown in FIG. 2(*b*), main bearing-side keyways 51*a* with which the main bearing-side keys 57*c* slide are provided in the back surface of the main bearing member 51. The main bearing-side keys 57*c* are slidably fitted into the main bearing-side keyways 51*a*.

As shown in FIG. 2(*c*), scroll-side keyways 12*d* with which the scroll-side keys 57*b* slide are provided in the back surface of the panel 12*a* of the orbiting scroll 12. The scroll-side keys 57*b* are slidably fitted into the scroll-side keyways 12*d*.

A sliding direction of the scroll-side keys 57*b* in the scroll-side keyways 12*d* and a sliding direction of the main bearing-side keys 57*c* in the main bearing-side keyways 51*a* intersect with each other at right angles.

The pair of scroll-side keys 57*b* are disposed at locations deviated from each other from a diameter line X of the ring portion 57*a*. A distance La between the pair of scroll-side keys 57*b* is not less than a width Ma of the scroll-side keyway 12*d* or not less than a width Na of the scroll-side key 57*b*.

The pair of main bearing-side keys 57*c* are disposed at locations deviated from each other from a diameter line Y of the ring portion 57*a*. A distance Lb between the pair of main bearing-side keys 57*c* is not less than a width Mb of the main bearing-side keyway 51*a* or not less than a width Nb of the main bearing-side key 57*c*.

The scroll-side keys 57*b* and the main bearing-side keys 57*c* are disposed such that they do not project from an outer diameter of the ring portion 57*a* and they do not project from an inner diameter of the ring portion 57*a*. Therefore, it is unnecessary to provide a release portion in the vicinity of the main bearing-side keyway 51*a* of the main bearing member 51 for avoiding interference with respect to the main bearing-side key 57*c*. A shape in the vicinity of the key of a mold which manufactures a raw material of the Oldham ring 57 is simplified and thus, a life span of the mold is increased, and a lathe can be used for machining inner and outer peripheral surfaces of the ring portion 57*a*. Therefore, productivity is enhanced, strengths of root portions of the scroll-side keys 57*b* and the main bearing-side keys 57*c* are enhanced and reliability is enhanced.

Rotation of the crankshaft 14 is transmitted to the cylindrical portion 12*c* of the orbiting scroll 12. The orbiting scroll 12 moves in a first direction which is restricted by the scroll-side keys 57*b* and the scroll-side keyways 12*d*, and in a second direction which is restricted by the main bearing-side keys 57*c* and the main bearing-side keyways 51*a*, and the orbiting scroll 12 is prevented from rotating. Since the first direction and the second direction intersect with each other at right angles, movement in the first direction and movement in the second direction are combined with each other, and the orbiting scroll 12 orbits with an orbiting radius e' shown in FIG. 3.

According to the above-described configuration, the pair of main bearing-side keyways 51*a* provided in the back surface of the main bearing member 51 are located at positions escaping from a thrust support 51*b* provided centers thereof. Therefore, a sliding length p' (see FIG. 3) of the main bearing-side keyway 51*a* can be made long as compared with a case where the main bearing-side keyway 51*a* is provided on the diameter line Y of the main bearing member 51. A width O of the ring portion 57*a* of the Oldham ring 57 can be made small as compared with a case where the main bearing-side key 57*c* is provided on the diameter line Y of the ring portion 57*a* and the scroll-side key 57*b* is provided on the diameter line X of the ring portion 57*a*. As a result, since the outer diameter of the ring portion 57*a* can be made small, the compressing mechanism 4 can be made compact.

If the orbiting radius e' becomes large, an outer diameter ϕn' (see FIG. 3) of the envelope circle of the seal member 24 at the back surface of the panel 12*a* becomes large. However, since the pair of scroll-side keyways 12*d* are located at positions deviated from each other from the diameter line X of the panel 12*a*, the scroll-side keyways 12*d* do not interfere with the envelope circle having the outer diameter ϕn', and sealing performance is not deteriorated. Thus, the orbiting radius e' can be designed large.

The scroll-side keys 57*b* and the main bearing-side keys 57*c* of the Oldham ring 57 may be formed from members different from that of the ring portion 57*a*, and the individually molded pair of scroll-side keys 57*b* and pair of main bearing-side keys 57*c* may be assembled and fixed to the ring portion 57*a*.

In this case, the ring portion 57*a* is provided with concave portions, and the scroll-side keys 57*b* and the main bearing-side keys 57*c* are provided with convex portions. The convex portions of the scroll-side keys 57*b* and the main bearing-side keys 57*c* are assembled and fixed to the concave portions of the ring portion 57*a* by a method such as press-fitting and shrink-fitting.

By forming the scroll-side keys 57*b* and the main bearing-side keys 57*c* from the members different from that of the ring portion 57*a*, it is possible to reduce weight and cost by employing light and inexpensive material for the ring portion 57*a*. If material having excellent sliding performance and having excellent compatibility with the scroll-side keyways 12*d* and the main bearing-side keyways 51*a* is employed for the scroll-side keys 57*b* and the main bearing-side keys 57*c*, reliability is enhanced.

SECOND EMBODIMENT

Figure 4:
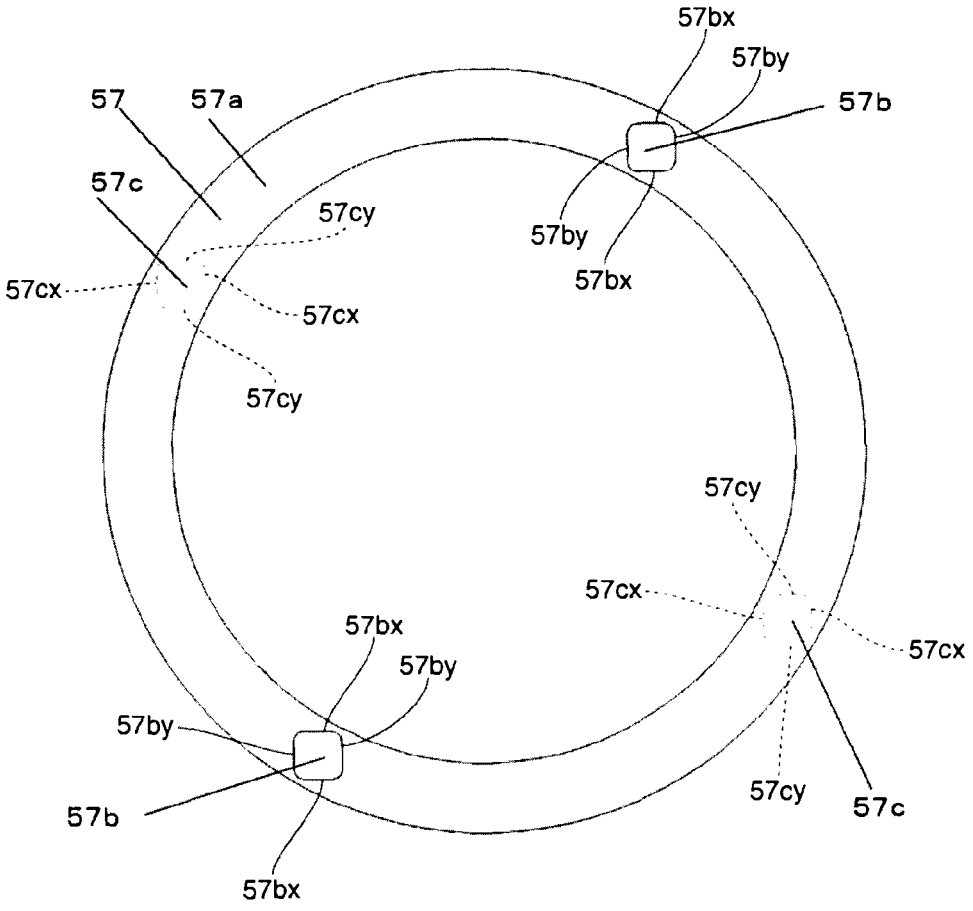
FIG. 4 is a plan view of an Oldham ring of a second embodiment of the invention.

FIG. 4 is a plan view of an Oldham ring of a second embodiment of the invention. Since configurations other than that of the Oldham ring are the same as those of the first embodiment, explanation thereof will be omitted.

Side surfaces of the pair of scroll-side keys 57*b* include sliding surfaces 57*bx* which slide with the scroll-side keyways 12*d*, and non-sliding surfaces 57*by* which do not slide with the scroll-side keyways 12*d*.

Side surfaces of the pair of main bearing-side keys 57*c* include sliding surfaces 57*cx* which slide with the main bearing-side keyways 51*a*, and non-sliding surfaces 57*cy* which do not slide with the main bearing-side keyways 51*a*.

In the embodiment, the sliding surfaces 57*bx* and 57*cx* as well as the non-sliding surfaces 57*by* and 57*cy* have the same shapes, and all of vertical and lateral lengths of the four side surfaces and R-shapes of corner portions have the same shapes.

According to this, it becomes easy to machine the four side surfaces of the scroll-side keys 57*b* and the main bearing-side keys 57*c*, and the productivity is enhanced.

When the individually molded pair of scroll-side keys 57*b* and pair off main bearing-side keys 57*c* are assembled and fixed to the ring portion 57*a*, since the shapes of the four side surfaces are the same and they do not have directional properties, errors in an assembling operation can be eliminated and the productivity is enhanced.

THIRD EMBODIMENT

Figure 5:
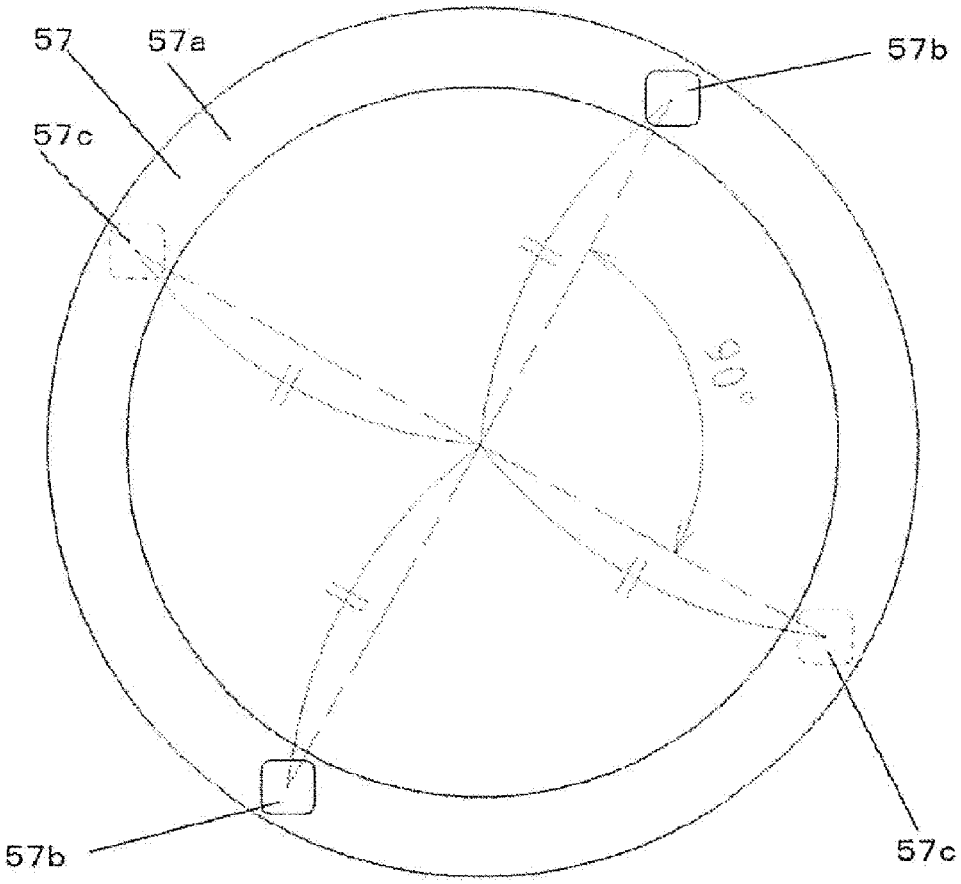
FIG. 5 is a plan view of an Oldham ring of a third embodiment of the invention.

FIG. 5 is a plan view of an Oldham ring of a third embodiment of the invention. Since configurations other than those of the Oldham ring are the same as those of the first embodiment, explanation thereof will be omitted.

In this embodiment, the scroll-side keys 57*b* and the main bearing-side keys 57*c* are disposed on the ring portion 57*a* such that a line segment which connects center points of the pair of scroll-side keys 57*b* and a line segment which connects center points of the pair of main bearing-side keys 57*c* intersect with each other at right angles at the center of the ring portion 57*a*.

According to this, the scroll-side keys 57*b* and the main bearing-side keys 57*c* are disposed symmetrically with respect to the center of the ring portion 57*a*, a front surface and a back surface of the Oldham ring 57 have the same shapes, circumferential directions thereof are also symmetric 180° and thus, the assembling errors are eliminated and the productivity is enhanced.

FOURTH EMBODIMENT

Figure 6:
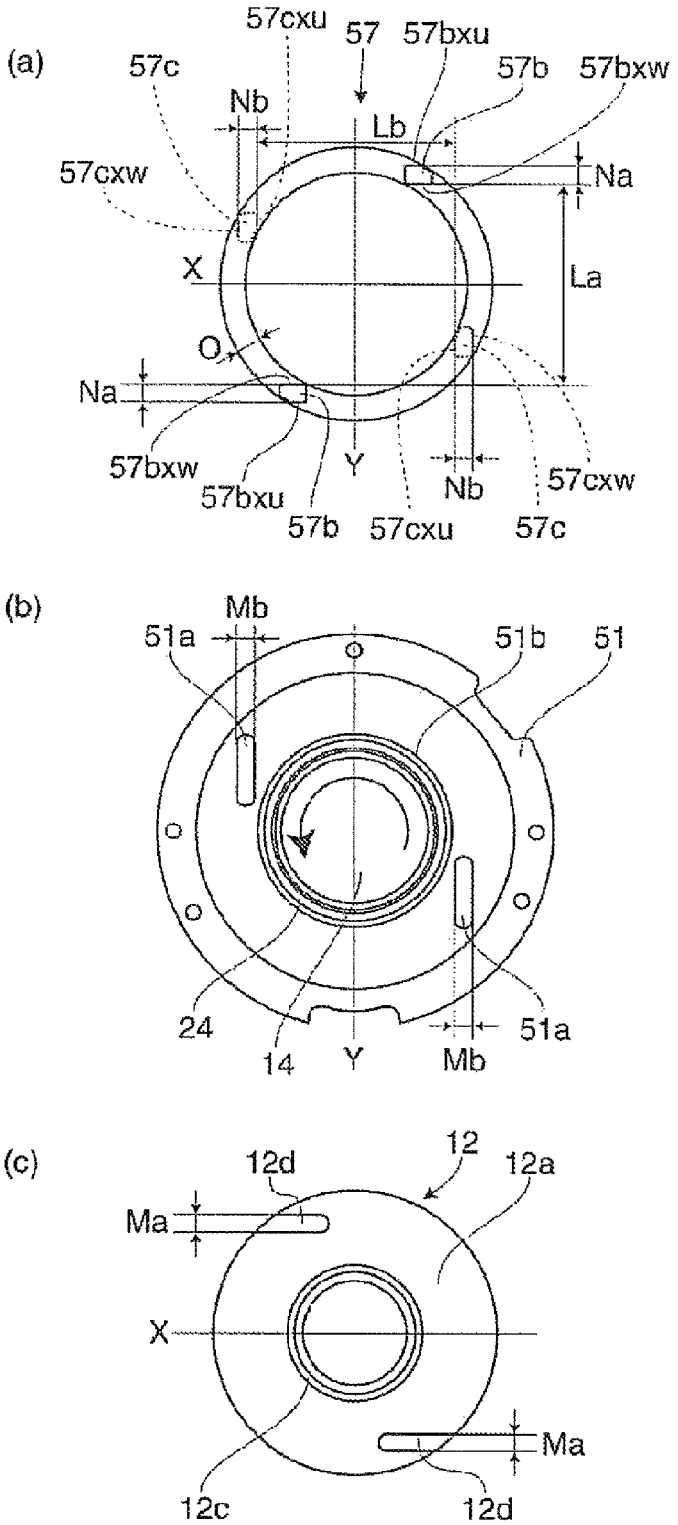
FIG. 6(*a*) is a plan view of an Oldham ring of a scroll compressor of a fourth embodiment as viewed from a fixed scroll, FIG. 6(*b*) is a plan view of a main bearing member of the scroll compressor of the fourth embodiment as viewed from the fixed scroll, and FIG. 6(*c*) is a plan view of an orbiting scroll of the scroll compressor of the fourth embodiment as viewed from a back surface of a panel.

FIG. 6(*a*) is a plan view of an Oldham ring of a scroll compressor of a fourth embodiment as viewed from a fixed scroll. FIG. 6(*b*) is a plan view of a main bearing member of the scroll compressor of the fourth embodiment as viewed from the fixed scroll. FIG. 6(*c*) is a plan view of an orbiting scroll of the scroll compressor of the fourth embodiment as viewed from a back surface of a panel.

Figure 7:
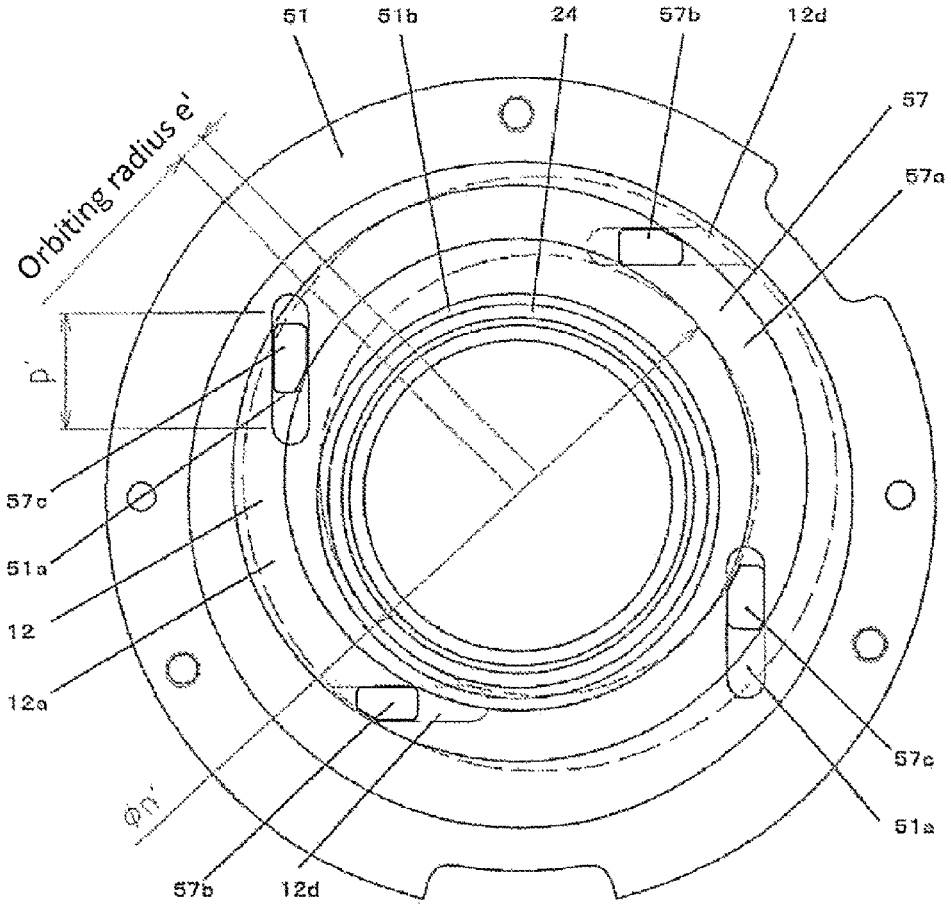
FIG. 7 is a plan view of a combination of the Oldham ring and the main bearing member of the fourth embodiment as viewed from the fixed scroll.

FIG. 7 is a plan view of a combination of the Oldham ring and the main bearing member of the fourth embodiment as viewed from the fixed scroll, and the orbiting scroll, the panel and the keyways are shown by dotted lines. An envelope circle at which a seal member disposed on the main bearing member comes into contact with the back surface of the panel is shown by a phantom line. Sine configurations other than that of the Oldham ring are the same as those of the first embodiment, explanation thereof will be omitted.

As shown in FIG. 6(*a*), the Oldham ring 57 includes a ring portion 57*a* which is formed into a ring shape, a pair of scroll-side keys 57*b* provided on one of surfaces of the ring portion 57*a*, and a pair of main bearing-side keys 57*c* provided on the other surface of the ring portion 57*a*.

As shown in FIG. 6(*b*), main bearing-side keyways 51*a* with which the main bearing-side keys 57*c* slide are provided in the back surface of the main bearing member 51. The main bearing-side keys 57*c* are slidably fitted into the main bearing-side keyways 51*a*.

As shown in FIG. 6(*c*), scroll-side keyways 12*d* with which the scroll-side keys 57*b* slide are provided in the back surface of the panel 12*a* of the orbiting scroll 12. The scroll-side keys 57*b* are slidably fitted into the scroll-side keyways 12*d*.

A sliding direction of the scroll-side keys 57*b* in the scroll-side keyways 12*d* and a sliding direction of the main bearing-side keys 57*c* in the main bearing-side keyways 51*a* intersect with each other at right angles.

The pair of scroll-side keys 57*b* are disposed at locations deviated from each other from a diameter line X of the ring portion 57*a*. A distance La between the pair of scroll-side keys 57*b* is not less than a width Ma of the scroll-side keyway 12*d* or not less than a width Na of the scroll-side key 57*b*.

The pair of main bearing-side keys 57*c* are disposed at locations deviated from each other from a diameter line Y of the ring portion 57*a*. A distance Lb between the pair of main bearing-side keys 57*c* is not less than a width Mb of the main bearing-side keyway 51*a* or not less than a width Nb of the main bearing-side key 57*c*.

The scroll-side keys 57*b* and the main bearing-side keys 57*c* are disposed such that they do not project from an outer diameter of the ring portion 57*a* and they do not project from an inner diameter of the ring portion 57*a*. Therefore, it is unnecessary to provide a release portion in the vicinity of the main bearing-side keyway 51*a* of the main bearing member 51 for avoiding interference with respect to the main bearing-side key 57*c*. A shape in the vicinity of the key of a mold which manufactures a raw material of the Oldham ring 57 is simplified and thus, a life span is increased, and a lathe can be used for machining inner and outer peripheral surfaces of the ring portion 57*a*. Therefore, productivity is enhanced, strengths of root portions of the scroll-side keys 57*b* and the main bearing-side keys 57*c* are enhanced and reliability is enhanced.

Sliding surfaces which are side surfaces of each of the pair of scroll-side keys 57*b* and which slide with the scroll-side keyways 12*d* include a load-side sliding surface 57*bxw* which receives a load depending upon a rotation direction of the crankshaft 14 and a non-load-side sliding surface 57*bxu* which does not receive a load depending upon the rotation direction of the crankshaft 14.

Sliding surfaces which are side surfaces of each of the pair of main bearing-side keys 57*c* and which slide with the main bearing-side keyways 51*a* include a load-side sliding surface 57*cxw* which receives a load depending upon the rotation direction of the crankshaft 14 and a non-load-side sliding surface 57*cxu* which does not receive a load depending upon the rotation direction of the crankshaft 14.

Here, the crankshaft 14 rotates in a direction of the arrow in FIG. 6(*b*), i.e., in a counterclockwise direction when the main bearing member 51 is viewed from the fixed scroll 11.

In this embodiment, areas of the non-load-side sliding surfaces 57*bxu* and 57*cxu* are set smaller than areas of the load-side sliding surfaces 57*bxw* and 57*cxw*.

According to the embodiment, since the areas of the non-load-side sliding surfaces 57*bxu* and 57*cxu* are set smaller than the areas of the load-side sliding surfaces 57*bxw* and 57*cxw*, the width O of the ring portion 57*a* of the Oldham ring 57 can be made small and an outer diameter of the Oldham ring 57 can be made small.

In the embodiment, the areas of the non-load-side sliding surfaces 57*bxu* and 57*cxu* are not less than halves of the areas of the load-side sliding surfaces 57*bxw* and 57*cxw*.

According to the embodiment, since the areas of the non-load-side sliding surfaces 57*bxu* and 57*cxu* are not less than halves of the areas of the load-side sliding surfaces 57*bxw* and 57*cxw*, even in an unstable operation state immediately after start of operation, or in a transitory state or when the compressor is at rest, although gaps are generated between the scroll-side keys 57*b* and the scroll-side keyways 12*d* or between the main bearing-side keys 57*c* and the main bearing-side keyways 51*a*, backlash is suppressed, the compressor can be operated stably and the reliability is enhanced.

In this embodiment also, the scroll-side keys 57*b* and the main bearing-side keys 57*c* of the Oldham ring 57 may be formed from members different from that of the ring portion 57*a*, and the individually molded pair of scroll-side keys 57*b* and pair of main bearing-side keys 57*c* may be assembled and fixed to the ring portion 57*a*.

In this case, the ring portion 57*a* is provided with concave portions, and the scroll-side keys 57*b* and the main bearing-side keys 57*c* are provided with convex portions. The convex portions of the scroll-side keys 57*b* and the main bearing-side keys 57*c* are assembled and fixed to the concave portions of the ring portion 57*a* by a method such as press-fitting and shrink-fitting.

By forming the scroll-side keys 57*b* and the main bearing-side keys 57*c* from the members different from that of the ring portion 57*a*, it is possible to reduce weight and cost by employing light and inexpensive material for the ring portion 57*a*. If material having excellent sliding performance and having excellent compatibility with the scroll-side keyways 12*d* and the main bearing-side keyways 51*a* is employed for the scroll-side keys 57*b* and the main bearing-side keys 57*c*, reliability is enhanced.

FIFTH EMBODIMENT

Figure 8:
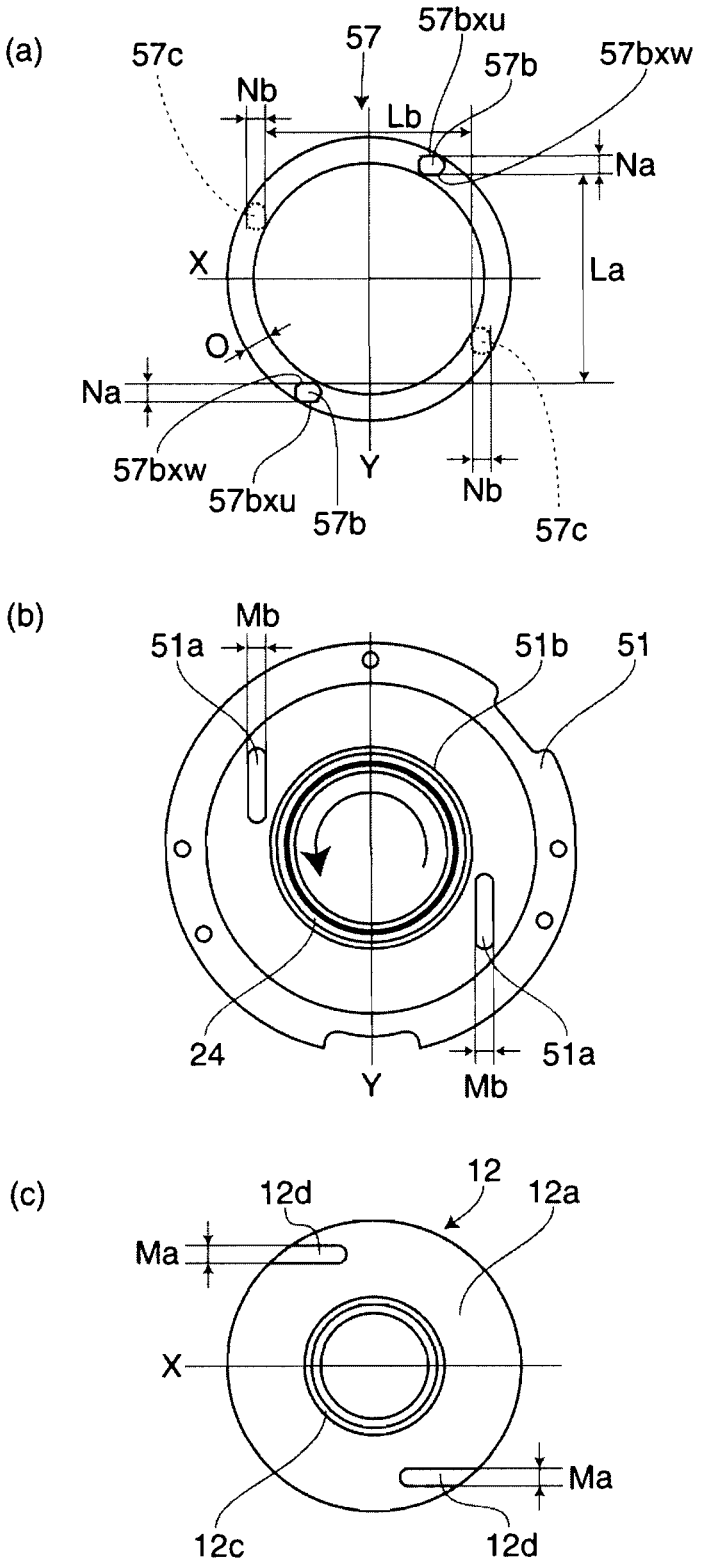
FIG. 8(*a*) is a plan view of an Oldham ring of a scroll compressor of a fifth embodiment as viewed from a fixed scroll, FIG. 8(*b*) is a plan view of a main bearing member of the scroll compressor of the fifth embodiment as viewed from the fixed scroll, and FIG. 8(*c*) is a plan view of an orbiting scroll of the scroll compressor of the fifth embodiment as viewed from a back surface of a panel.

FIG. 8(*a*) is a plan view of an Oldham ring of a scroll compressor of a fifth embodiment as viewed from a fixed scroll. FIG. 8(*b*) is a plan view of a main bearing member of the scroll compressor of the fifth embodiment as viewed from the fixed scroll. FIG. 8(*c*) is a plan view of an orbiting scroll of the scroll, compressor of the fifth embodiment as viewed from a back surface of a panel.

Figure 9:
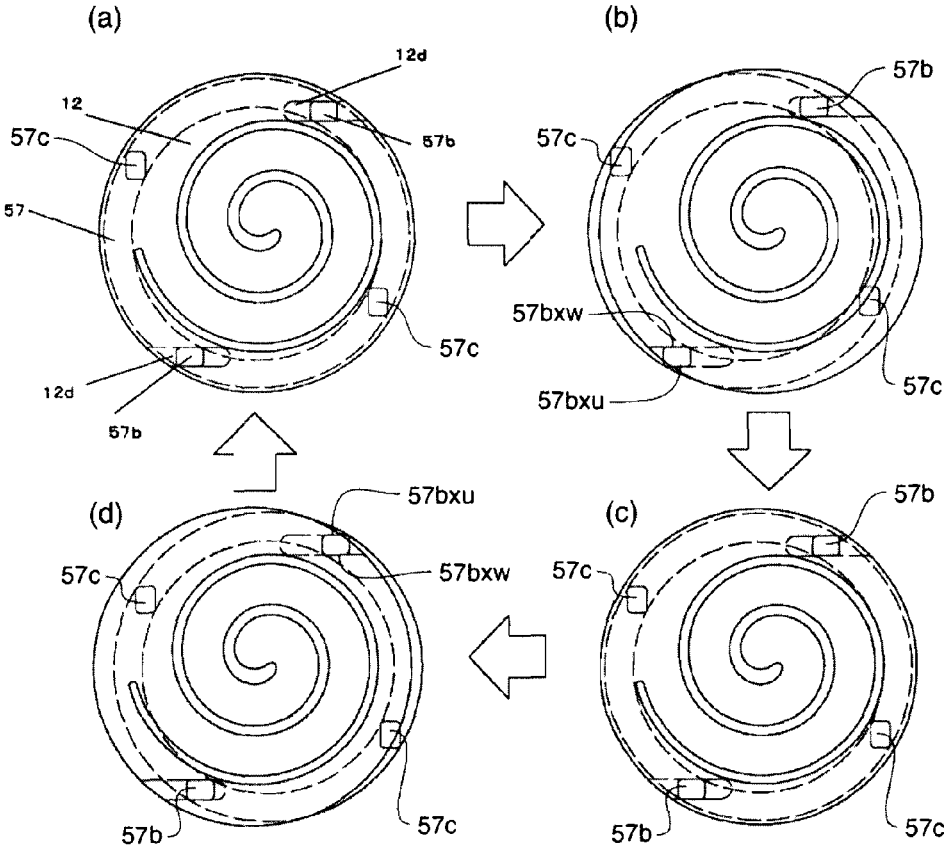
FIGS. 9(*a*) to 9(*d*) are sectional views of essential portions of a combination of the Oldham ring and the orbiting scroll of the fifth embodiment as viewed from the fixed scroll, FIG. 10(*a*) is an exploded perspective view of a compressing mechanism of a conventional scroll compressor as viewed from a fixed scroll, and FIG. 10(*b*) is an exploded perspective view of an orbiting scroll and an Oldham ring of the conventional scroll compressor as viewed from a back surface.
Figure 10:
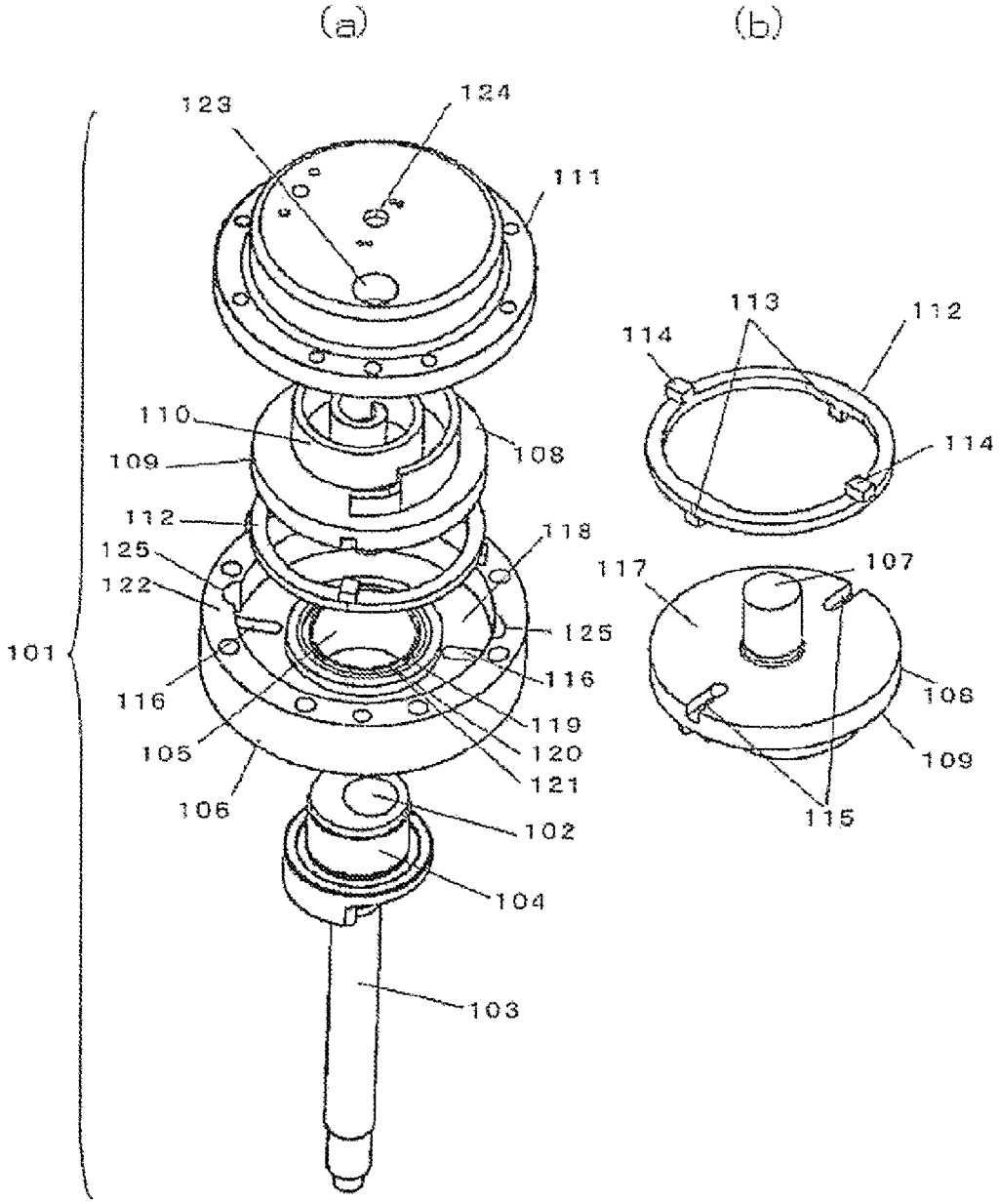
Figure 11:
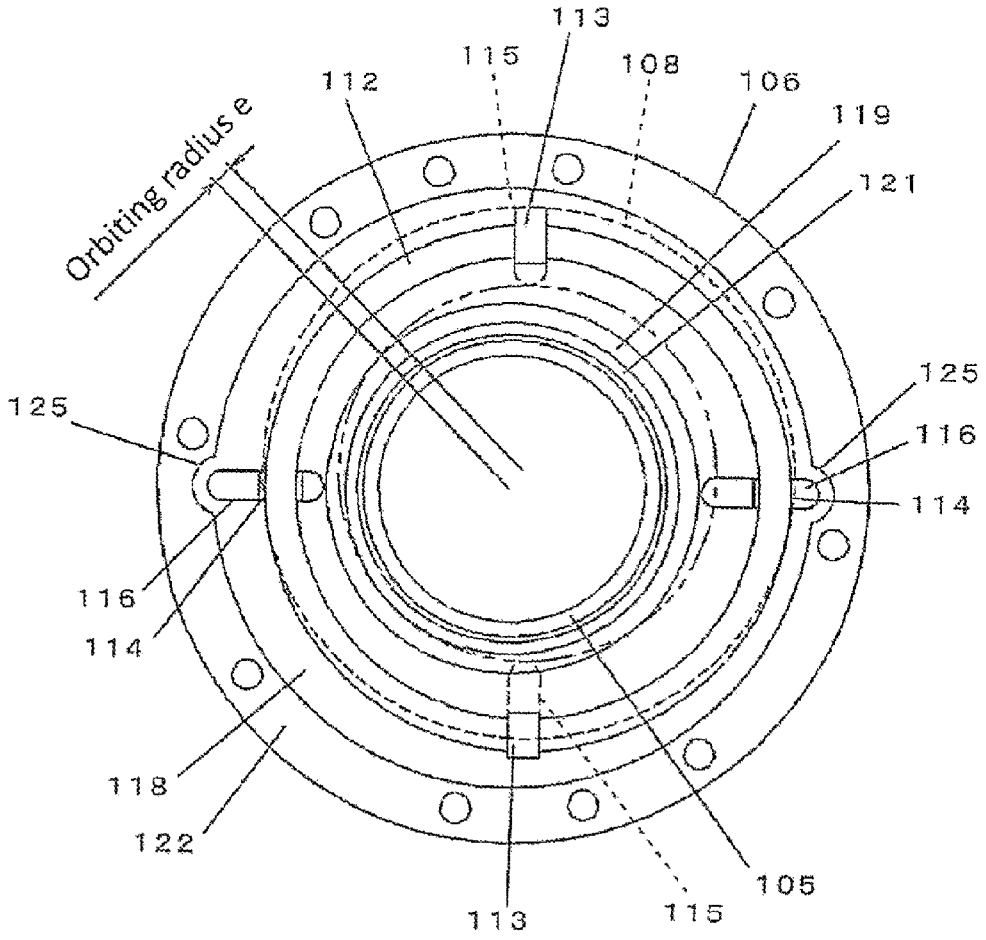
FIG. 11 is a plan view of a bearing member and the Oldham ring of the scroll compressor shown in FIG. 10 as viewed from the back surface of the bearing member.

FIGS. 9(*a*) to 9(*d*) are sectional views of essential portions of a combination of the Oldham ring and the orbiting scroll of the fifth embodiment as viewed from the fixed scroll.

As shown in FIG. 8(*a*), the Oldham ring 57 includes a ring portion 57*a* which is formed into a ring shape, a pair of scroll-side keys 57*b* provided on one of surfaces of the ring portion 57*a*, and a pair of main bearing-side keys 57*c* provided on the other surface of the ring portion 57*a*.

As shown in FIG. 8(*b*), main bearing-side keyways 51*a* with which the main bearing-side keys 57*c* slide are provided in the back surface of the main bearing member 51. The main bearing-side keys 57*c* are slidably fitted into the main bearing-side keyways 51*a*.

As shown in FIG. 8(*c*), scroll-side keyways 12*d* with which the scroll-side keys 57*b* slide are provided in the back surface of the panel 12*a* of the orbiting scroll 12. The scroll-side keys 57*b* are slidably fitted into the scroll-side keyways 12*d*.

A sliding direction of the scroll-side keys 57*b* in the scroll-side keyways 12*d* and a sliding direction of the main bearing-side keys 57*c* in the main bearing-side keyways 51*a* intersect with each other at right angles.

The pair of scroll-side keys 57*b* are disposed at locations deviated from each other from a diameter line X of the ring portion 57*a*. A distance La between the pair of scroll-side keys 57*b* is not less than a width Ma of the scroll-side keyway 12*d* or not less than a width Na of the scroll-side key 57*b*.

The pair of main bearing-side keys 57*c* are disposed at locations deviated from each other from a diameter line 7 of the ring portion 57*a*. A distance Lb between the pair of main bearing-side keys 57*c* is not less than a width Mb of the main bearing-side keyway 51*a* or not less than a width Nb of the main bearing-side key 57*c*.

The scroll-side keys 57*b* and the main bearing-side keys 57*c* are disposed such that they do not project from an outer diameter of the ring portion 57*a* and they do not project from an inner diameter of the ring portion 57*a*. Therefore, it is unnecessary to provide a release portion in the vicinity of the main bearing-side keyway 51*a* of the main bearing member 51 for avoiding interference with respect to the main bearing-side key 57*c*. A shape in the vicinity of the key of a mold which manufactures a raw material of the Oldham ring 57 is simplified and thus, a life span is increased, and a lathe can be used for machining inner and outer peripheral surfaces of the ring portion 57*a*. Therefore, productivity is enhanced, strengths of root portions of the scroll-side keys 57*b* and the main bearing-side keys 57*c* are enhanced and reliability is enhanced.

Sliding surfaces which are side surfaces of each of the pair of scroll-side keys 57*b* and which slide with the scroll-side keyways 12*d* include a load-side sliding surface 57*bxw* which receives a load depending upon the rotation direction of the crankshaft 14 and a non-load-side sliding surface 57*bxu* which does not receive a load depending upon the rotation direction of the crankshaft 14.

Here, the crankshaft 14 rotates in a direction of the arrow in FIG. 8(*b*), i.e., in a counterclockwise direction when the main bearing member 51 is viewed from the fixed scroll 11.

In this embodiment, the non-load-side sliding surface 57*bxu* projects outward from the scroll-side keyway 12*d*, and the load-side sliding surface 57*bxw* does not project outward from the scroll-side keyway 12*d*.

Here, a projecting area of the non-load-side sliding surface 57*bxu* which projects outward from the scroll-side keyway 12*d* is not more than half of the entire area of the load-side sliding surface 57*bxw*.

In a state shown in FIG. 9(*b*), the non-load-side sliding surface 57*bxu* of one of the scroll-side keys 57*b* projects outward from the scroll-side keyway 12*d*. In a state shown in FIG. 9(*d*), the non-load-side sliding surface 57*bxu* of the other scroll-side key 57*b* projects outward from the scroll-side keyway 12*d*.

According to this embodiment, when the compressor is stable, the non-load-side sliding surface 57*bxu* of the scroll-side key 57*b* does not receive a force. Therefore, even if the non-load-side sliding surface 57*bxu* projects from the outer diameter of the orbiting scroll 12 one time per one rotation, orbiting motion and compressing motion are not influenced, and the outer diameter of the orbiting scroll 12 can be made small by the projecting amount. Hence, the compressing mechanism 4 can be made compact, and it is possible to design the compressing mechanism 4 such that the orbiting radius is increased in size.

According to the embodiment, since the projecting area of the non-load-side sliding surface 57*bxu* is not more than half of the entire area of the load-side sliding surface 57*bxw* and according to this, the area of the non-load-side sliding surface 57*bxu* is set to not less than the half of the area of the load-side sliding surface 57*bxw*. Therefore, even in an unstable operation state immediately after start of operation, or in a transitory state or when the compressor is at rest, backlash generated by the gap of the scroll-side key 57*b* is suppressed, the compressor can be operated stably and the reliability is enhanced.

In this embodiment also, the scroll-side keys 57*b* and the main bearing-side keys 57*c* of the Oldham ring 57 may be formed from members different from that of the ring portion 57*a*, and the individually molded pair of scroll-side keys 57*b* and pair of main bearing-side keys 57*c* may be assembled and fixed to the ring portion 57*a*.

In this case, the ring portion 57*a* is provided with concave portions, and the scroll-side keys 57*b* and the main bearing-side keys 57*c* are provided with convex portions. The convex portions of the scroll-side keys 57*b* and the main bearing-side keys 57*c* are assembled and fixed to the concave portions of the ring portion 57*a* by a method such as press-fitting and shrink-fitting.

By forming the scroll-side keys 57*b* and the main bearing-side keys 57*c* from the members different from that of the ring portion 57*a*, it is possible to reduce weight and cost by employing light and inexpensive material for the ring portion 57*a*. If material having excellent sliding performance and having excellent compatibility with the scroll-side keyways 12*d* and the main bearing-side keyways 51*a* is employed for the scroll-side keys 57*b* and the main bearing-side keys 57*c*, reliability is enhanced.

The ring portion 57*a* of the Oldham ring 57 may be a long circular ring-shape having two arcs connected to each other through straight portions.

INDUSTRIAL APPLICABILITY

As described above, according to the scroll compressor of the present invention, since the outer diameter of the Oldham ring can be made small, it is possible to reduce the compressing mechanism in size, and it is possible to design the compressing mechanism such that the orbiting radius is further increased in size. Therefore, the invention can be applied to an air scroll compressor, a vacuum pump and a scroll fluid machine such as a scroll expansion machine without limiting working fluid to the refrigerant.

The invention claimed is:

1. A scroll compressor comprising a compressing mechanism, in which the compressing mechanism comprises:

a crankshaft including an eccentric shaft, a main bearing member which rotatably supports the crankshaft, an orbiting scroll which is rotatably fitted to the eccentric shaft, a fixed scroll which meshes with the orbiting scroll to form a compression space, and an Oldham ring which prevents the orbiting scroll from rotating, the Oldham ring comprises:

a ring-shaped ring portion, a pair of scroll-side keys, each having sliding contact surfaces on its side surfaces, provided on one surface of the ring portion, and a pair of main bearing-side keys, each having sliding contact surfaces on its side surfaces, provided on the other of the surfaces of the ring portion, wherein the orbiting scroll is provided with scroll-side keyways across which the sliding contact surfaces of the scroll-side keys slide, the main bearing member is provided with main bearing-side keyways across which the sliding contact surfaces of the main bearing-side keys slide, a sliding direction of the scroll-side keys in the scroll-side keyways and a sliding direction of the main bearing-side keys in the main bearing-side keyways intersect with each other at right angles, the pair of scroll-side keys are disposed at locations deviated from each other from a diameter line of the ring portion so that a distance between the pair of scroll-side keys becomes equal to or greater than a width of the scroll-side keyway, the pair of main bearing-side keys are disposed at locations deviated from each other from the diameter line of the ring portion so that a distance between the pair of main bearing-side keys becomes equal to or greater than a width of the main bearing-side keyway, the sliding contact surfaces of the pair of scroll-side keys comprise:

load-side sliding contact surfaces of the scroll-side keys that receive loads during rotation of the crankshaft, and non-load-side sliding contact surfaces of the scroll-side keys that do not receive loads during the rotation of the crankshaft, and when one of the scroll-side keys is at the farthest position from a center of the orbiting scroll, a part of the non-load-side sliding contact surface of the one of the scroll-side keys projects from the scroll-side keyway, and the load-side sliding contact surface of the one of the scroll-side keys does not project from the scroll-side keyway.

2. The scroll compressor according to claim 1, wherein the scroll-side key and the main bearing-side key do not project from an outer diameter of the ring portion, and do not project from an inner diameter of the ring portion.

3. The scroll compressor according to claim 1, wherein the sliding contact surfaces of the main bearing-side keys include load-side sliding contact surfaces of the main bearing-side keys that receive loads during a rotation of the crankshaft, and non-load-side sliding contact surfaces of the main bearing-side keys that do not receive loads during the rotation of the crankshaft, and an area of the non-load-side sliding contact surface of the main bearing-side keys is smaller than an area of the load-side sliding contact surface of the main bearing-side keys.

4. The scroll compressor according to claim 3, wherein the area of the non-load-side sliding contact surface of the main bearing-side key is not less than half of the area of the load-side sliding contact surface of the main bearing-side key.

5. The scroll compressor according to claim 1, wherein a projecting area of the non-load-side sliding contact surface of the one of the scroll-side keys projecting from the scroll-side keyway is not more than half of an entire area of the load-side sliding contact surface of the one of the scroll-side keys.

6. The scroll compressor according to claim 1, wherein the pair of scroll-side keys and the pair of main bearing-side keys are formed by individual molding, and they are assembled and fixed to the ring portion.

7. The scroll compressor according to claim 1, wherein a line segment which connects centers of the pair of scroll-side keys with each other and a line segment which connects centers of the pair of main bearing-side keys intersect with each other at right angles at a center of the ring portion.

* * * * *